United States Patent [19]

Moreau

[11] 4,336,665

[45] Jun. 29, 1982

[54] CONVERTIBLE STUFFED TOY

[75] Inventor: Claude R. M. Moreau, Elmhurst, N.Y.

[73] Assignee: AMTOY, Inc., New York, N.Y.

[21] Appl. No.: 179,759

[22] Filed: Aug. 20, 1980

[51] Int. Cl.[3] ..... A63H 3/12
[52] U.S. Cl. ..... 46/153
[58] Field of Search ..... 46/153, 151

[56] References Cited

U.S. PATENT DOCUMENTS

| | | | |
|---|---|---|---|
| 1,396,766 | 11/1921 | McClelland | 46/153 |
| 2,195,127 | 3/1940 | Brucker | 46/153 |
| 3,911,617 | 10/1975 | Gelfand | 46/151 |

FOREIGN PATENT DOCUMENTS

| | | | |
|---|---|---|---|
| 163916 | 9/1949 | Austria | 46/153 |

*Primary Examiner*—F. Barry Shay
*Attorney, Agent, or Firm*—Yount & Tarolli

[57] ABSTRACT

A convertible stuffed toy having a pair of soft, generally round head members disposed with their neck members connected together with a common juncture and having face portions disposed toward opposite directions from each other and a reversible shell fabric cover connected to said head members along said common juncture for flipping movement about said common juncture and said shell fabric cover being selectively flippable about the common junction to cover and conceal one head while leaving the other head visible, the concealed head serving as the body of the visible head.

6 Claims, 6 Drawing Figures

FIG. 1
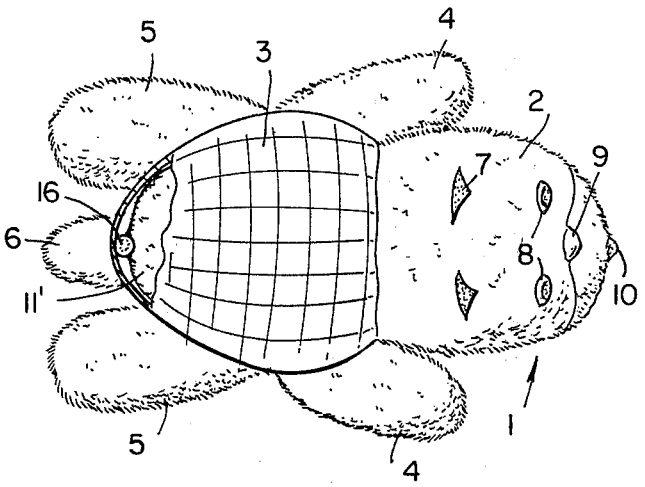
FIG. 2
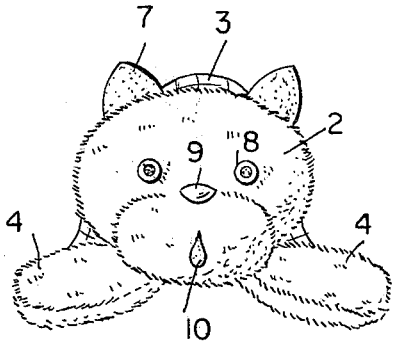
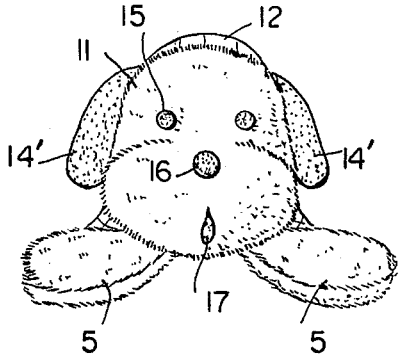
FIG. 3
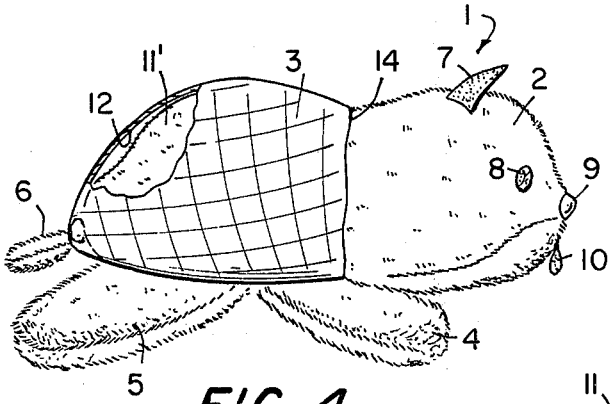
FIG. 4
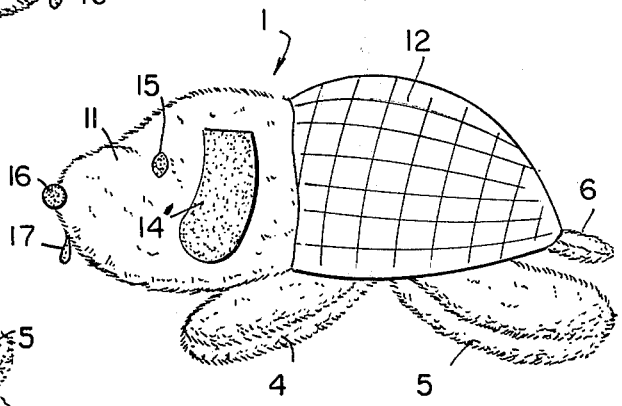
FIG. 6
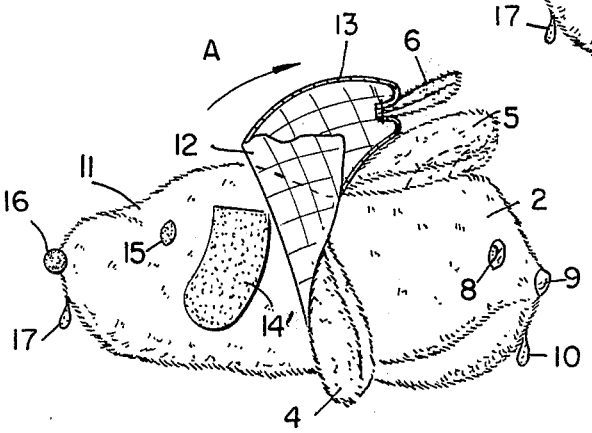
FIG. 5

CONVERTIBLE STUFFED TOY

The present invention relates to a convertible stuffed toy that, by means of a simple flipping of a shell cover, can be changed back and forth between one of two stuffed toys. The convertible toy may represent two different animals or dolls, so that the child can flip between them as he or she chooses.

In particular, the present invention provides a convertible stuffed toy, comprising first and second soft, generally round, head members, each head member having a face portion at one end and a neck portion opposite thereto, said head members being disposed with their neck portions connected together with a common juncture and with their face portions disposed toward opposite directions, and a reversible shell fabric cover connected to said head members along said common juncture for flipping movement about said common juncture, said shell cover being selectively movable between a first position in which said head member is covered by said shell cover and the face portion thereof is concealed by said shell cover while said second head member is visible and a second position in which said second head member is covered by said shell cover and the face portion thereof is concealed by said shell cover while said first head member is visible, said shell cover being movable between said positions by lifting said shell cover off of one of the head members, turning it inside out and swinging it over the other head member, the head member concealed by said shell cover serving as the body of the visible head member.

The present invention is illustrated in terms of a preferred embodiment in the accompanying drawing, in which:

FIG. 1 is a top plan view of the toy of the present invention;

FIG. 2 is an end elevational of the toy shown in FIG. 1;

FIG. 3 is a similar view of the opposite end;

FIG. 4 is a side elevational view showing the toy in one position;

FIG. 5 is a side elevational view showing the cover being flipped over to expose the head of the toy concealed in FIG. 4; and FIG. 6 is a side elevational view showing the toy in its other position.

Referring to FIGS. 1–3 of the drawing, the convertible toy 1 of the invention comprises a soft, stuffed head member 2, which is shown by way of example as a cat's head 2, and a fabric cover 3 in the form of a shell cover having the cat's appendages, i.e., front feet 4, back feet 5 and a tail 6. Fabric shell cover 3 can be decorated with a realistic or fanciful pattern, as desired. The head member 2 is a soft, stuffed cat's head having a face portion with the features of a cat, such as ears 7, eyes 8, nose 9 and tongue 10 (FIG. 2). As can best be seen in FIGS. 1 and 3 concealed under the cover 3 is a body 11 formed as a soft, stuffed body.

The appearance of the animal 1 in FIGS. 1, 2 and 3 is of a more or less conventional stuffed cat, but when the shell cover 3 is pulled away from the body portion 11' in the direction of arrow A in FIG. 5, it is revealed that body portion 11' is actually a soft, stuffed dog's head. When the cover 3 is swung, turned inside out and then pulled all the way over the cat's head 2, a dog's head 11 is fully revealed (FIG. 5) and the animal 1 is now converted to a dog. The top cover 3 shown in FIGS. 1–3 is a fabric appropriate to serve as a cat's body, and this is sewn to a bottom shell cover 12 (FIG. 5), which is appropriate for a dog's body, shell covers 3 and 12 being sewn together along their perimeter at seam 13 and being sewn to the animal 1 along seam 14. As an example, if shell cover side 3 is of a calico fabric and shell cover side 12 is of a gingham fabric, an animal toy 1 is provided that converts from a gingham dog to a calico cat and vice versa.

As best seen in FIG. 6, the body portion 11' has a face with the features of a dog's head, namely floppy ears 14', eyes 15, nose 16 and tongue 17. Each portion 2 and 11 is, thus of a rounded shape to serve as a body portion when concealed by shell covers 3 or 12 and having face portions so as to serve as a head when visible. The appendages, i.e., feet 4, 5 serve as feet for both body portions 2 and 11 and the tail 6 also accommodates both bodies 2 and 11.

The reversible shell covers 3 and 12 are made of fabric so that the shell cover formed when it is over one of the head members 2 and 11 can be turned inside out and pulled fully over the head member 2 and 11 to conceal one face portion thereof. Preferably, the head members 2 and 11 are stuffed with a soft filling or stuffing, to allow the head to be snugly fitted or "stuffed" into the shell cover.

What is claimed:

1. A convertible toy, comprising first and second soft generally round, head members, each head member having a face portion at one end and a neck portion opposite thereto, said head members being disposed with their neck portions connected together with a common juncture and with their face portions disposed toward opposite directions, and a reversible fabric cover in the form of a shell cover connected to said head members along said common juncture for flipping movement about said common juncture, said cover being selectively movable between a first position in which said first head member is covered by said cover and the face portion thereof is concealed by said cover while said second head member is visible and a second position in which said second head member is covered by said cover and the face portion thereof is concealed by said cover while said first head member is visible, said cover being movable between said positions by lifting said cover off one of the head members, turning it inside out and flipping it over the other head member, the head member concealed by said cover serving as a body associated with the visible head member, a plurality of appendage members connected to said shell cover, said plurality of appendage members being movable with said shell cover and in either of said first or second positions of said shell cover forming all of the appendages visibly associated with the head member which is visible, and said appendage members being designed so that when said shell is moved from one of said positions to the other all of the appendage members are reversed and visibly associated with the head which is visible.

2. The toy according to claim 1, wherein said plurality of appendage members comprises four appendage members attached to said shell cover at its perimeter, said four appendage members representing the front and rear feet of an animal or arms or legs of a doll, and said face portions are each of a different animal or doll.

3. The toy according to claim 2, wherein said plurality of appendage members includes a fifth appendage member attached to said shell cover and representing the tail of said animal.

4. The toy according to claim 2, wherein said shell cover has a top side and a bottom side, said sides being of different patterns to provide a different body for each face portion.

5. The toy according to claim 4, wherein said sides are fabrics of different design patterns secured together.

6. The toy according to claim 5, wherein said head members are stuffed with a soft filling material.

* * * * *